United States Patent [19]

Seragnoli

[11] 4,056,917

[45] Nov. 8, 1977

[54] SYSTEM FOR TRANSFERRING AND STORING CIGARETTES

[75] Inventor: Enzo Seragnoli, Bologna, Italy

[73] Assignee: G. D. Societa per Azioni, Italy

[21] Appl. No.: 651,335

[22] Filed: Jan. 22, 1976

[30] Foreign Application Priority Data

Jan. 29, 1975 Italy ..... 3322/75

[51] Int. Cl.[2] ..... B65B 57/14

[52] U.S. Cl. ..... 53/59 R; 53/148; 198/347; 214/6 TS

[58] Field of Search ..... 53/59 R, 148; 198/20 C, 198/37, 20 R, 103, 347; 131/25; 221/79, 81, 103, 105; 214/6 TS

[56] References Cited

U.S. PATENT DOCUMENTS

| | | | |
|---|---|---|---|
| 3,499,555 | 3/1970 | Wahle | 198/347 |
| 3,782,523 | 1/1974 | Giatti | 198/347 |

*Primary Examiner*—Othell M. Simpson

*Assistant Examiner*—John Sipos

*Attorney, Agent, or Firm*—Robert E. Burns; Emmanuel J. Lobato; Bruce L. Adams

[57] ABSTRACT

A compensating store device for cigarettes, between cigarette manufacturing machines and machines for packeting the cigarettes, wrapping the packets and making and wrapping packs of wrapped packets. The store device comprises a cylinder rotating about a vertical axis and having vertical, radial cigarette storage compartments, circumferentially distributed. A cigarette delivery channel at the top of this body feeds cigarettes to the compartments, and tilts so as not to loose its free and open, cigarette-feeding connections to the compartment in the rotating cylinder. Similarly, a cigarette-removing channel at the bottom of the cylinder is tiltably mounted. Between these channels, successive, horizontal rods, cantilevering from a support are moved into, downwardly along, and ultimately from each compartment.

7 Claims, 17 Drawing Figures

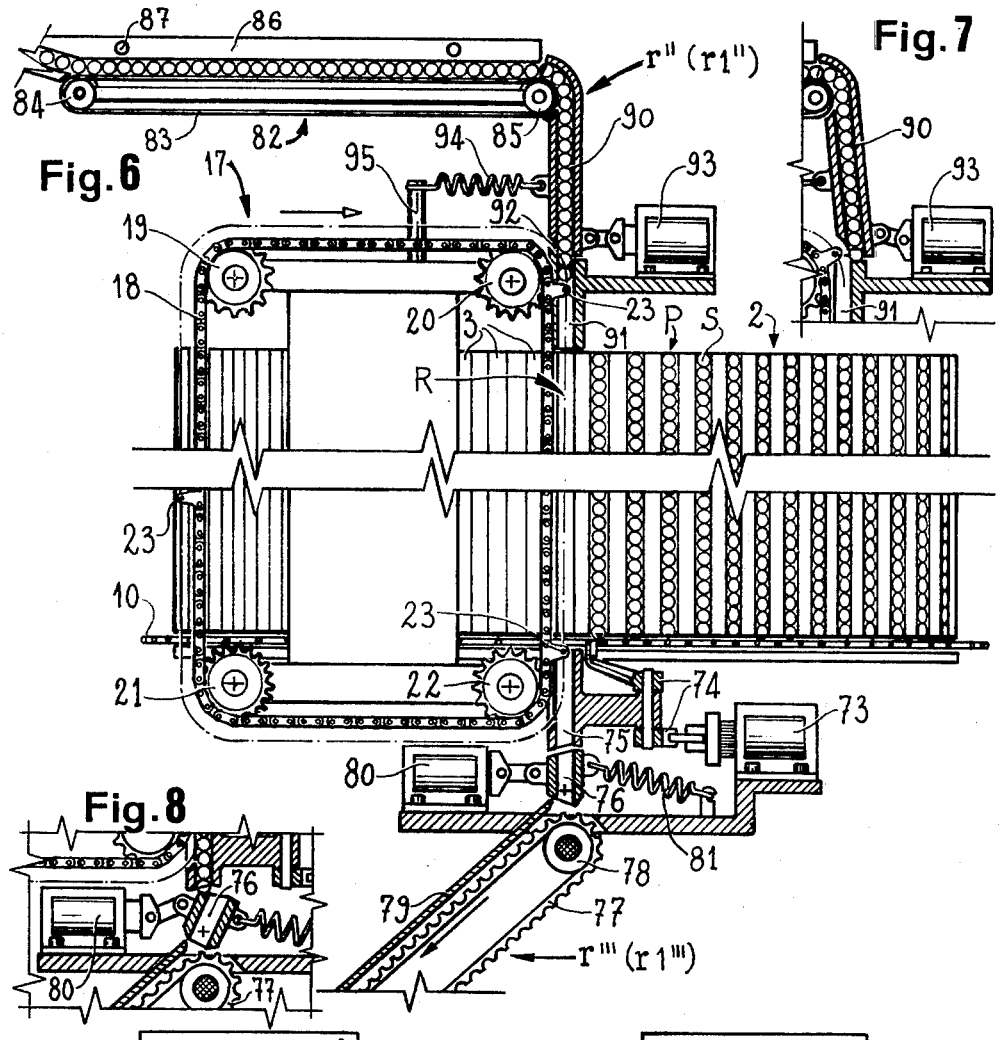
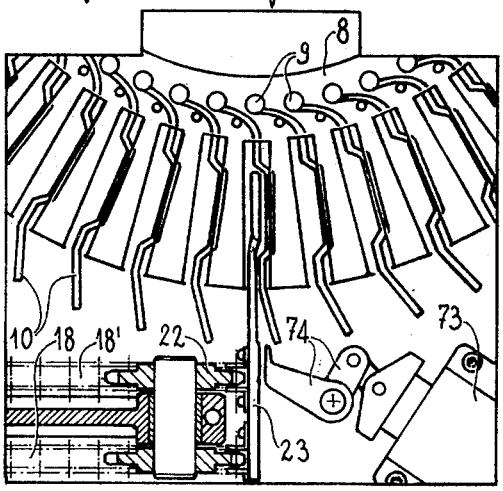
Fig. 9
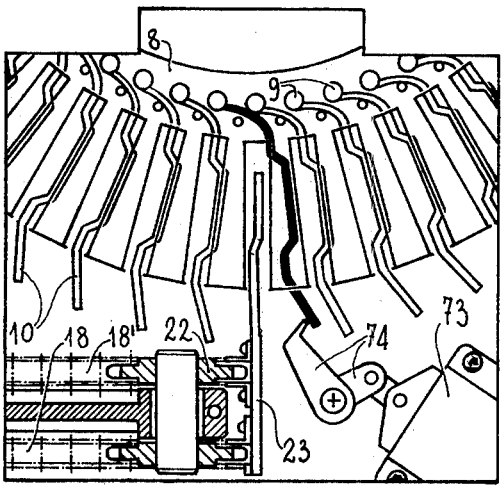
Fig. 10

Fig. 12
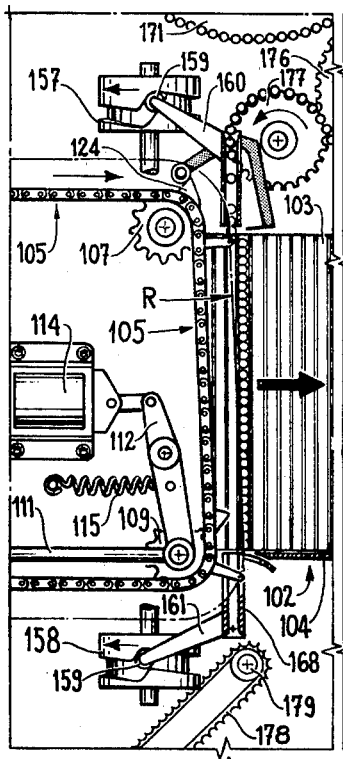
Fig. 13
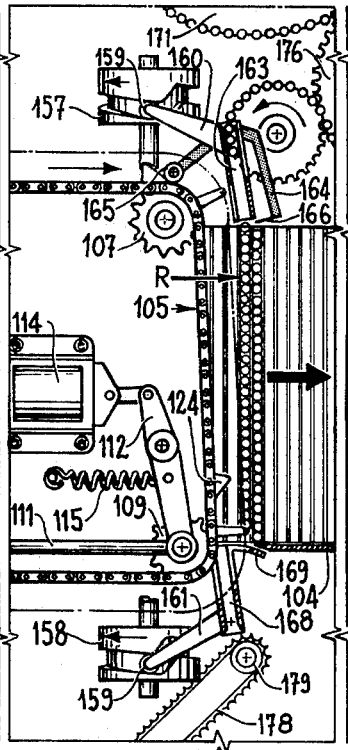
Fig. 14
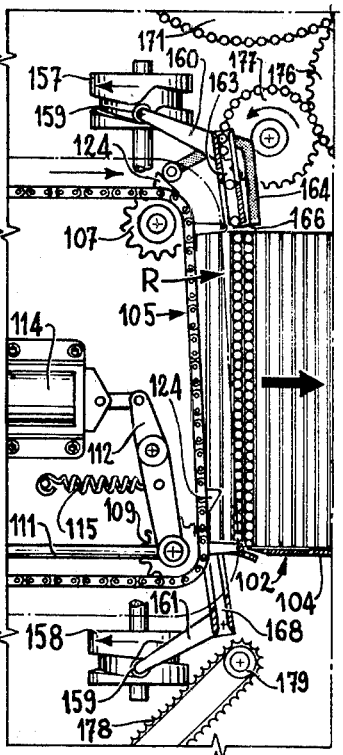
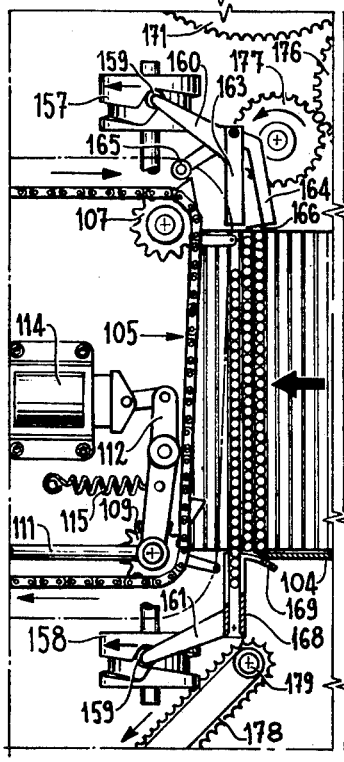
Fig. 15
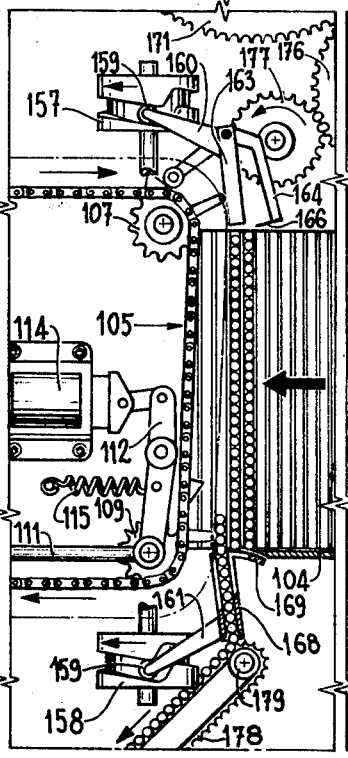
Fig. 16
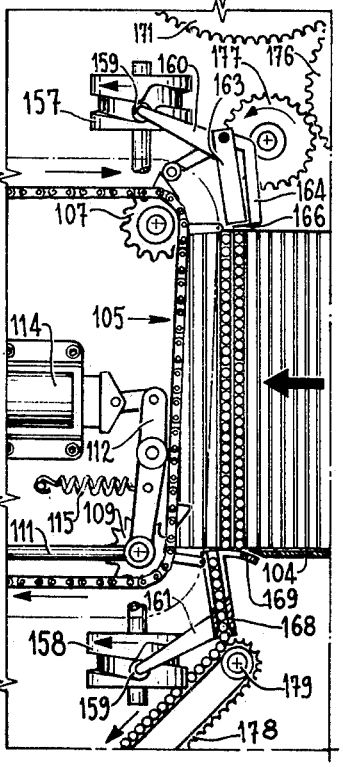
Fig. 17

SYSTEM FOR TRANSFERRING AND STORING CIGARETTES

CROSS REFERENCE TO OTHER APPLICATIONS

This application is related to U.S. Patent Applications Ser. No. 651,332 and Ser. No. 651,334 both filed on Jan. 22, 1976.

BACKGROUND OF THE INVENTION

The present oinvention relates to systems for producing cigarettes in which the cigarettes are directly transferred from cigarette manufacturing machines to the cigarette batching hopper which feeds the cigarettes to the wrapping line of a packaging machine. The new system includes a store device for compensating for differentials in the output of said machines. More precisely, the subject matter of the invention is such a system which comprises a compensation store having a vertical-axis cylindrical body of high capacity.

As known, the cigarette producing systems or plants in use at present include two different kinds of machine, i.e.

1. Machines for producing cigarettes from minced and cured tobacco leaves, usually called cigarette manufacturing machines, and 2. Cigarette packaging machines. The machines of this second kind usually comprise:

Machines for producing packets of cigarettes, usually called packeting machines;

Machines for producing packs of cigarette packets, usually called packing machines, and Wrapping machines for wrapping both single packets of cigarettes, also called "cellophaning machines", and single packs of cigarettes, usually called "over-wrapping machines".

In such plants, the cellophaning machines are arranged between the packeting machines and the packing machines, whereas the over-wrapping machines are arranged downstream of or after the packing machines.

It is also known that various kinds of cigarette manufacturing machine are adopted in practice and operate at a respective output speed of 2000 to 4000 cigarettes per minute.

There also exist various kinds of packaging machines which operate at output speeds of 100 to 120 up to 400 packets of cigarettes per minute, whereas the output speed of the packing machines is a function of the number of packets in each single pack. Among the wrapping machines for wrapping single packets of cigarettes, the Applicant's assignees' cellophaning machine which can wrap 400 packets of cigarettes per minute is widely used.

Single packs are usually wrapped by means of over-wrapping machines which operate at the same output speed as that of the packing machines co-operating therewith.

When considering the output speed of the various types of machine in use at present, it is found that depending on the types of machine used in forming the system or plant, a packeting machine can absorb the production or output of one to three manufacturing machines, whereas a cellophaning machine can deal with the output of one to three packeting machines.

As known, cigarettes are transferred from the manufacturing machine(s) to the packeting machine substantially in two different ways, i.e.

a. either by unloading the cigarettes into containers at the outlet of the cigarette manufacturing machine(s), the containers being then transferred and unloaded into the grouping or assembling hopper arranged to feed the packeting line of the packeting machine, b. or by directly connecting such outlet of the cigarette manufacturing machine(s) to the assembling hopper arranged to feed the packeting line of the packeting machine.

The present invention concerns the latter branch of the art, in which the output of the manufacturing machine(s) is directly connected to the hopper of the packeting machine.

For such a kind of system, it was already suggested to feed cigarettes to the packeting machine by continuously transferring cigarettes from the cigarette manufacturing machine(s), the cigarettes, while being transferred, are arranged, as known, in a succession of single cigarettes or are gathered into batches by providing along the cigarette path means arranged to permit changes in the feeding speed to be made as a function of changes in the feeding capacity of the manufacturing machine(s) and in the receiving capacity of the packeting machine in such a way as to compensate for frequently occurring unbalances in the production or output of said machines.

According to the proposals known at present, said means arranged to permit variations in the cigarette flow rate to be made as a function of variations in the output and receiving capacities of said machines are provided, conceived and designed as having structures such as to be able to act on batches of cigarettes, in contact with each other inside or outside the hopper of the packeting machine.

On such batchwise treating of cigarettes in contact with each other either while the cigarettes are simply transferred or especially while the same are piled up in order to compensate for frequently occurring unbalances in the output of the power-consuming machines, the cigarettes are subjected to stress. The results, already during this initial step of the process, in a damage being caused to the cigarettes, in particular to the structural characteristics of the cigarettes (loss of compactness in the tobacco inside the cigarette envelope or paper).

For such reasons, systems have been proposed for the direct feeding system mentioned at paragraph (b), in which various transfer means and even means arranged to permit changes in the flow rate act on single cigarettes rather than on cigarette batches. In order to eliminate the drawbacks due to direct connection between machines running at different operating speeds, such systems have used a compensation store for compensating for unbalances which may occur owing to such different operating speeds, the cigarettes being stored one-by-one in the store and being withdrawn therefrom still one-by-one in case of need.

For instance, a device having a substantially cylindrical body which is about equal in height to the length of a cigarette, and comprising radial compartments all around it, the compartments being about equal in width to the diameter of a cigarette and variable in depth and being arranged to contain cigarette piles extending parallel to the axis of said cylindrical body is already known.

Such a device is continuously rotated about its own axis and its compartments, the depth of which uniformely increases or decreases depending on whether a storing or a withdrawal operation is being performed, successively reach a well determined position, so that during each 360° rotation every compartment receives a cigarette in the first operating condition thereof and delivers it in the second condition.

It should be noted that in view of this such storing and withdrawing operations are carried out by following a spiral-like course.

From the above, it should appear that the maximum amount of cigarettes which can be stored is proportional to the diameter of the cylindrical body and this means that precise limits exist for the capacity and thus for the utility of such device.

Such a compensation store is subject to both size and weight limitations, the weight limitations being due to the fact that the speed of rotation of a particular storing and withdrawing mechanism has necessarily to match with the high output speed of the machines co-operating therewith.

it should be also noted that the cigarettes located in the innermost turns of said spiral will be only seldom withdrawn and this might be deleterious to the structural characteristics thereof.

SUMMARY OF THE INVENTION

The main object of the present invention is to obviate all the above mentioned drawbacks by providing a system with a compensation store device of large capacity as compared to its relatively small dimensions, and of particularly simple structure.

Another object of the present invention is to provide a compensation store device by means of which both the storing and withdrawing operations are performed by equal series of cigarettes arranged side-by-side.

A further object of the present invention is to provide a compensation store device arranged to attain the above mentioned objects and having such a structure that it is possible to begin the cigarette withdrawing operation by starting from the cigarettes first stored.

These and still further objects are all attained by the system or plant. According the invention the store comprises a cylindrical body having radial store compartments for cigarettes and being able to rotate about its vertical axis to carry successive radial store compartments past means for delivering and withdrawing transversally arranged cigarettes, comprising an upper cigarette supplying duct and a lower cigarette withdrawing duct, a mobile device carries a plurality of overhanging rods spaced from each other and co-operating with mechanism linked to said machines and controlling the rotation of said cylindrical body about its vertical axis, the mobile device being arranged to locate at least one of said overhanging rods in a position perpendicular to said vertical axis within the radial store compartment which is found between said upper supplying duct and said lower withdrawing duct so as to support the cigarettes while entering said radial store compartment for being stored therein and to assist them while being withdrawn. Mobile locking means co-operate with said mechanism to cut off the cigarette flow between said upper and lower ducts and the respective inlet and outlet ends of said radial store compartment in synchronization with each passage of successive radial store compartments between said upper and lower ducts.

BRIEF DESCRIPTION OF THE DRAWINGS

Further characteristics and advantages will better appear from the following detailed description of two preferred non-exclusive embodiments of the compensation store device of the system according to the invention, given by way of non-limiting examples only and illustrated in the accompanying drawings in which:

FIG. 6 is a side view of said device, FIGS. 7 and 8 show details of FIG. 6 in different positions, FIGS. 9 and 10 are plan views showing a detail of the same device in two different operating conditions, FIGS. 12, 13, 14 are side views of such device in a first series of operating conditions, and FIGS. 15, 16, 17 are side views of the same device in a second series of operating conditions.

DESCRIPTION OF THE PREFERRED EMBODIMENTS

Figure 1:
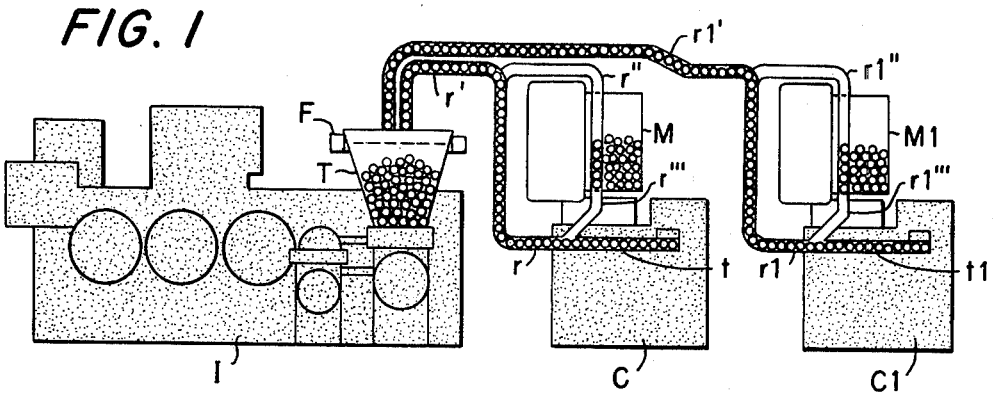
FIGS. 1, 2, 3, 4 digrammatically show the four possible modes of operation of the plant which employs the system according to the Patent Application Ser. No. 651,345 of the same Applicant.
Figure 2:
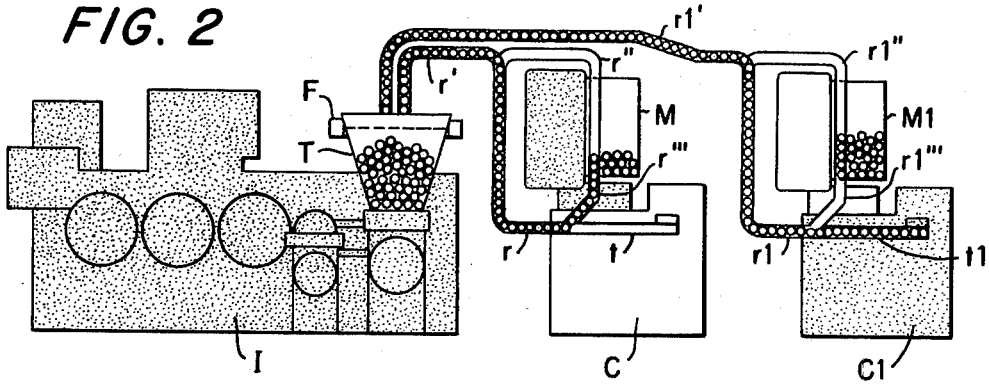
Figure 3:
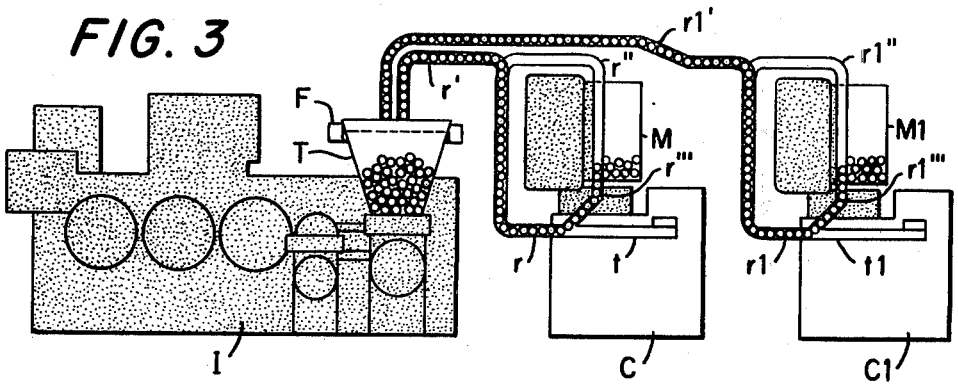
Figure 4:
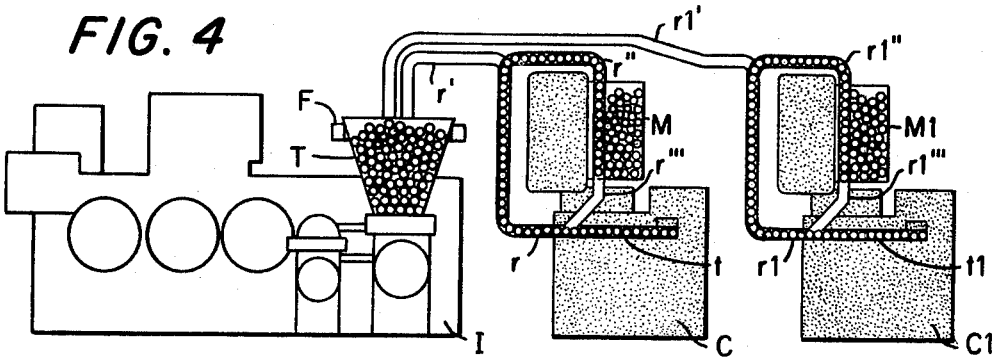

The plant shown in FIGS. 1, 2, 3, 4 and comprising the direct feeding system according to the Patent Application referred to above, has a packeting machine I with high unitary output, of the type known on the market under the name of X1 of Applicant G. D. SOCIETA' PER AZIONI, which produces 400 cigarette packets per minute, the packets being of the so-called soft or American kind and each containing about 20 cigarettes; two cigarette manufacturing machines C and C1, also of a known type, each of which operates at an output speed of about 4,000 cigarettes per minute; and two compensating store devices schematically shown M and M1, and respectively associated with the machine C and the machine C1.

As known, the packeting machine I comprises a grouping or assembling hopper T arranged to feed groups of cigarettes to the packeting line which is a part of the same machine, and a device F of any known type, such as a photocell, arranged to detect the reaching of a predetermined maximum level of the cigarettes in the hopper T and to control cigarette switching means, not shown in the drawings, for example of the type disclosed in the Patent Application Ser. No. 651,346 in the name of the same Applicant, when the packeting machine I stops.

The manufacturing machines C and C1 are of the type comprising a continuous conveying device *t* and *t*1, respectively, such as a belt conveyor, arranged to transfer a continuous succession of cigarettes transversely arranged with respect to the conveying or transfer direction from the outlet of the corresponding manufacturing machine to further conveying devices. Each of the latter conveying devices is of continuous type and arranged to act on single cigarettes. It comprises for example preferably grooved wheels or drums or meetually opposed belts, and has a first ascending run or section, more precisely the section *r*, which is an extension of the conveyor *t*, and the run or section *r*1 which is an extension of the conveyor *t*1, and finally, two sections or runs *r'*, *r''* diverging from one another and which are extensions of the sections *r* and *r1'*, *r1''*, the latter being extensions of the section *r1*.

The two runs or sections *r'* and *r1'* open into the hopper T, whereas the two runs *r''* and *r1''* open into the device M or the device M1, respectively. Said devices M and M1 are also connected respectively to conveying devices *t* and *t1* by a continuous conveyor *r'''* located between M and *t* and by means of the section of the continuous conveyor *r1'''* located between M1 and *t1*. Thus *r''*, *r1''* feed cigarettes to the store device, and *r'''*, *r1'''* withdraw cigarettes therefrom.

A plant of the type briefly described above which comprises compensating store devices arranged to compensate for frequently occurring unbalances in the output of the operating machines which are due to manufacturing machine stops or shutdowns more frequent than those of the packeting machine, can operate according to the following different operating conditions:

A. The packeting machine I and the manufacturing machines C and C1 are running and the compensating or compensation store devices M and M1 are stationary (see FIG. 1);

B. The packeting machine I and one of the two manufacturing machines are running, while the other manufacturing machine is stationary and the compensating store device of the latter is in a feeding or supplying stage (see FIG. 2, where the machine G is stationary and its compensating store device is running in a feeding or supplying stage);

C. The packeting machine I is running, the manufacturing machines C and C1 are stationary, and the compensating store devices M and M1 are in a feeding stage (see FIG. 3);

D. The packeting machine I is stationary and at least one manufacturing machine with its compensating store device is being supplied or fed (see FIG. 4, where both manufacturing machines C and C1 are working and both compensation store devices M and M1 are in a storing condition).

Figure 5:
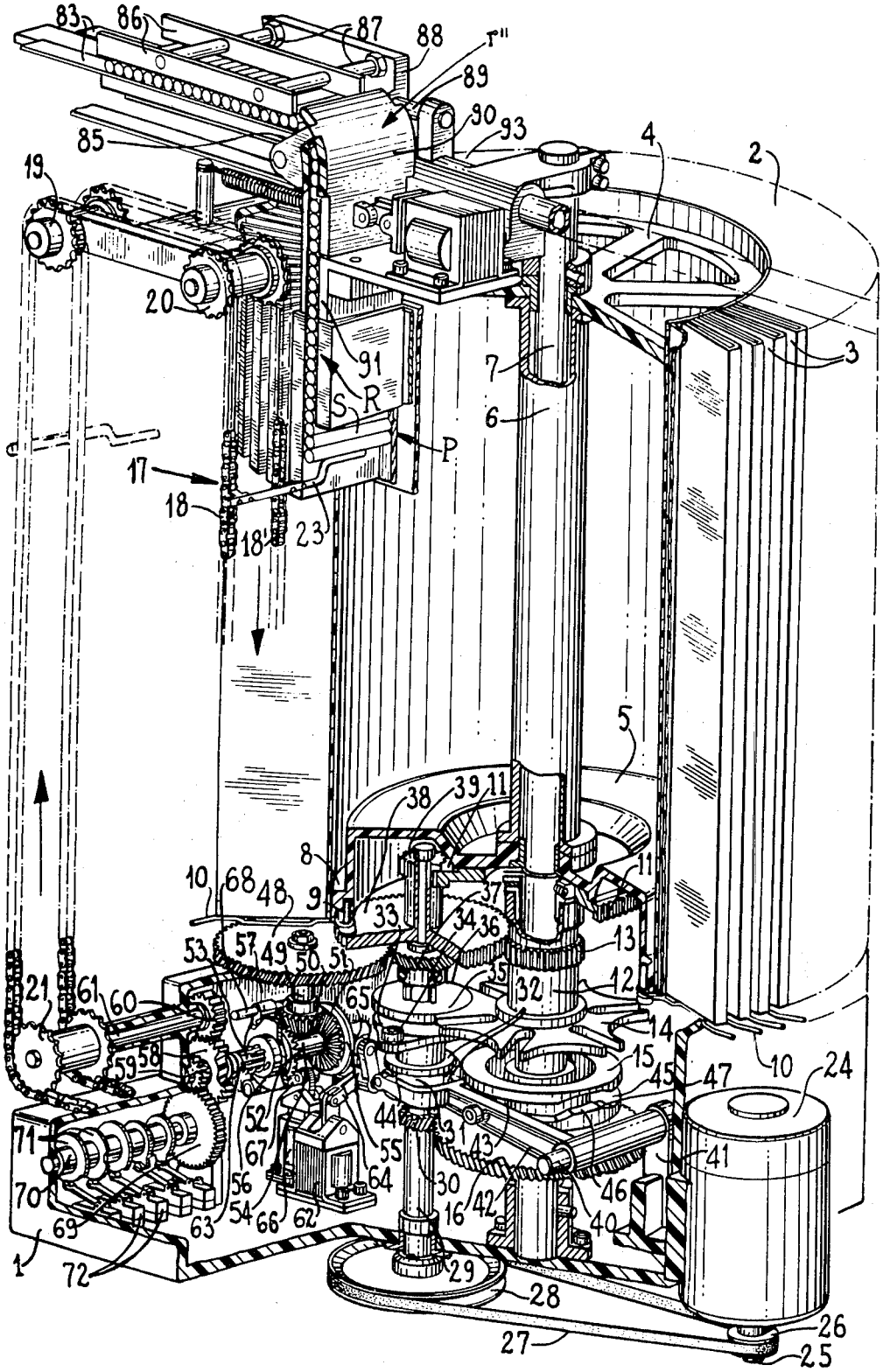
FIG. 5 is a perspective view, with parts cut away to better show others, of a first embodiment of the compensation store device equipped with its driv-ing means.

With particular reference to the first embodiment of the compensation store device shown in FIG. 5: a broken-off portion of a casing of device M(M1) has been indicated hereby by 1. It is rigid with the base of the respective cigarette manufacturing machine, not shown. A hollow cylindrical body with vertical axis is generally indicated by 2 and has radial compartments 3 all around it which are equally spaced from each other and are about equal in depth and width to the length and width, respectively, of a cigarette. They vertically extend from the top or upper base to the bottom or lower base of the cylindrical body and are arranged to be receive and discharge by piles P of cigarettes S from the manufacturing machine, each pile being one cigarette thick.

An upper plate 4 and a lower drum 5 are rigidly positioned inside said cylindrical body, which forms the compensating or compensation store proper, and are also rigid with the vertical hollow shaft 6 which is rotatably supported by the shaft 7 which extends throughout the shaft 6 and has its ends fixed to the casing 1, the shaft 7 defining the axis about which, as will be explained below, said store can intermittently rotate in two opposite directions.

The drum 5 has at its lower part, see also FIGS. 6, 9 and 10, a ring gear 8 along which resilient rods 10 are fixed by means of vertical pins 9. The number and distribution of rods 10 is equal to that of the compartments 3. The rods 10 extend in a substantially radial direction and all lie in the same horizontal plane immediately below the lower base of the cylindrical body 2, the dimensions of the rods 10 being such as to extend to a given extent radially beyond the limits of said base.

The configuration of the rods 10 in that plane is such that each of them obstructs the two radial ends of a lower opening or outlet of one of the compartments 3, so as to form a support for a possible cigarette pile P located above it.

The inner shaft 7 also carries in the order from above downwards a gear 11 rigid with a lower portion of the drum 5 and a second hollow idle shaft 12 on which a gear 13 is formed.

At the lower end of the hollow shaft 12, a six-slot Maltese cross 14 is keyed to transmit intermittent rotational movement to the cylindrical body 2, as will be better explained below.

Said shaft 7 also carries, below the hollow shaft 12, a drum cam 15 and a gear 16 which are idly mounted thereon and rigid with one another.

The end portion of the section or run (*r''* or *r1''*) arranged to feed the cigarettes to the compensating store device is located immediately above the cylindrical body 2, whereas the initial length of the run or section (*r'''* or *r1'''*) arranged to withdraw the cigarettes from said device is located immediately below said cylindrical body 2. Such initial and end lengths are vertically aligned with one another and have an outlet and an inlet, respectively, radially extending with respect to the cylindrical body 2 and define a station R at which the compartments 3 come to stop one by one to perform filling or, alternatively, unloading operations.

Moreover, a conveying means is indicated by 17 (see FIGS. 5 and 6) and comprises two chains 18, 18' located side by side and endlessly wound around four pairs of sprocket wheels 19, 20, 21 and 22 having horizontal axes parallel to a plane diametrical of cylinder 2 passing through said feeding and withdrawing station R, said conveying means being continuously moved clockwise with respect to an observer looking at FIGS. 5 and 6, by means described below. One of the pairs of sprocket wheels 19, 20, 21, 22, as will be better described below, is motor-driven. The four pairs are arranged at the corners of a rectangle so that a vertical conveyor run or length, directly moving from above downwards, is located close to said feeding and withdrawing station R.

The two chains 18, 18' are connected to one another at regular intervals by three bars or rods 23 transversely arranged with respect to the conveying direction and cantilevering from the two chains on the side facing the cylindrical body 2, so as to be carried by the descending vertical length deeply inserted firstly into a terminal end of the feed run or section (*r''* or *r1''*) then into and through the compartment 3 which is located opposite said station R, and finally through the initial end of the withdrawing section (*r'''* or *r1'''*) without however interfering with said rods 10.

As a primary source of motion the device has a motor 24 which can rotate in either direction of rotation and is fixed to the casing 1.

A pulley 26 is keyed to the vertical shaft 25 of such motor 24. The pulley 26 rotates, through a drive belt 27, a second pulley 28 which is keyed to a lower end, projecting from the casing 1, of a vertical shaft 29. A gear 30 is keyed to such shaft 29 within the casing 1, this gear 30 being arranged to rotate the already mentioned gear 16 and drum cam 15.

Above the gear 30, there are mounted, rigid with one another and free to axially slide on said shaft 29, in the order from below upwards, a tubular sleeve 31 on which two equal rings or flanges 32 are keyed and suitably spaced apart from one another, and also a device of a known type arranged to intermittently actuate the Maltese cross 14. Such device comprises at its lower part a disc 33 which has a pin or an idle roller 34 with vertical axis and a second disc 35 arranged above the roller 34 and having, depending from its edge, an arcuate or centering sector 36 located diametrically opposite to said roller 34. Moreover, a gear 37 is fixed on said shaft 29 above said disc 36 and finally, two gears 38 and 39 are idly mounted on the shaft 29 and rigid with one another, the gears 38 and 39 being arranged to mesh with respective gears 13 and 11 already mentioned above.

The actuation of the Maltese cross 14, and the resulting intermittent rotation of the cylindrical body 2, in one direction or in the opposite direction, occurs in the following manner. One end of a lever 42 is fulcrumed on a horizontal pin 40 fixed to a vertical bar 41 internally rigid with the casing 1. The lever 42 has an intermediate horizontal axis idle roller 43 arranged to run along the groove of the drum cam 15.

The other end of the lever 42 terminates with two arms each of which carries an idle roller 44 with horizontal axis. Such rollers 44 are inserted in a diametrically opposite arrangement one with respect to the other into the tubular sleeve 31 between the two flanges or rings 32.

The groove in the drum cam 15 extends along the lateral surface of the cam at two different levels, that is a prevailing length 45 at a lower level and a length 46 at a higher level, spaced from one another by inclined sections 47.

While the idle roller 43 runs along the length or section 45 at the lower level (see FIG. 5), the idle roller 34 idly rotates about the shaft 29 at a lower level with respect to that of the Maltese cross 14, while the disc 35, which rotates in engagement with the arcuate end of one of the arms of such Maltese cross 14, acts as a stabilizing element.

At the end of this stage, dwelling stage of the cylindrical body 2, upon further rotation of the drum cam 15, one of the inclined sections 47 and thus the length of section 46 at a higher level, moves past the idle roller 43.

Accordingly, the lever 42 rotates upwardly about the pin 40, thereby causing, by means of the idle rollers 44, the tubular sleeve 31 to axially slide and thus causing the idle roller 34 and the arcuate sector 36 to be transferred to the respective operating zone of actuation of the Maltese cross 14.

The raised cam section 46 extends enough to permit, at each 360° rotation of the drum cam 15, the rotation of a step, i.e. through 60°, of the Maltese cross 14, and thus the rotation of the cylindrical body 2, by a step corresponding to the angle defined by two contiguous compartments 3, by means of suitable dimensioning of gears 13, 38 and 39, 11.

The above-mentioned gear 37, rigid with vertical shaft 29, drives a gear 48 mounted on a vertical shaft 49, the lower end of which is rigid with a bevel gear 50.

Said gear 50 in turn rotates either of two equal bevel gears 51, 52 having opposite toothings, being mounted axially slidable on a horizontal shaft 53 carried by the casing 1, and being rigidly connected to one another by means of a tubular sleeve 54 mounted on the same shaft 53.

Two discs 55, 56 equal to one another and having a diameter greater than that of said gears, are mounted on the horizontal shaft 53 close to and rigid with the bevel gear 51 and the bevel gear 52, respectively, on the opposite side to the respective toothings. A cut 57, the function of which will be explained below, is formed in the periphery of each of the discs 55, 56.

The two assemblies comprising said bevel gears 51 and 52 and the respective discs 55 and 56 formed with the cut 57 are mounted on the shaft 53 in such a way as to be each a mirror image of the other.

Moreover, gears 58 and 59 are keyed to the shaft 53, the gear 58 rotating a horizontal shaft 61 through a gear 60. The horizontal shaft 61 carries the sprocket wheels 21 mentioned above, which continuously rotate in the same direction.

The mechanism comprising said bevel gears 51 and 52 provides a uniform direction of rotation of the shaft 61 and thus a uniform conveying direction of the chain conveyor 18, and this independently of the variable direction of rotation of the motor 24 and cylindrical body 2.

In FIG. 5, it is assumed that the cylindrical body 2 is preset to intermittently rotate in one direction at such setting as will be better explained below, a cigarette piling-up or storing operation is being carried out in the compensating store device.

In that setting, the bevel gears 50 and 51 cause the sprockets 21 to be rotated in clockwise direction, as desired.

In the condition where the cylindrical body 2 intermittently rotates in the opposite direction, for a cigarette delivery operation, the bevel gear 50 which now also rotates in the opposite direction, is caused to mesh with the second bevel gear 52, thereby continuing the rotation, still in clockwise direction, of the sprocket wheels 21. The coupling of the bevel gear 50 with the gear 51 or alternatively with the gear 52 is performed by an electromagnet 62 in combination with a spring 63 mounted on the shaft 53 in the zone delimited between the disc 56 and the gear 58.

The keeper of such electromagnet 62 is connected to one arm of a lever 64 which is pivoted on means rigid with the casing 1 and the other arm of which is fork-shaped and carries two idle rollers 65, each having a horizontal axis and being arranged to engage with the disc 55 at the rear face portion with respect to a viewer of FIG. 5.

In order to set the device in the cigarette-storing condition described above, the electromagnet 62 is energized. Through the lever 64 and against the resistance of the spring 63 it then causes the assembly comprising the bevel gear 51 to axially slide from the right leftwards, and thus causes the bevel gear 51 to mesh with the bevel gear 50 which at this time rotates in counterclockwise direction. In order to preset said device in the other condition, said electromagnet 62 is instead deenergized. Owing to the urging action of the spring 63, the bevel gear 52 is then caused to mesh with the bevel gear 50, then rotating in the clockwise direction.

A second electromagnet 66 rigid with the casing 1 has a keeper connected to one arm of a two-armed lever 67 which is pivoted in casing 1 and has at the free end of its second arm, a rod 68 parallel to the shaft 53.

While the device changes from one to another of said operating conditions, upon stopping the motor 24 and before reversing its direction of rotation, the electromagnet 66 is energized.

As a consequence, the ends of the rod 68 come into contact with the contours of the two discs 55 and 56 rotating due to inertia, and then enter the two cuts 57 so as to form a guide element during the meshing change operation between the bevel gear 50 and the two bevel gears 51 and 52.

At the end of this operation, upon setting in motion the motor 24 in a direction of rotation opposite to the previous one, the sprocket wheel 21 starts rotating again always in the same direction of rotation.

The gear 59 continuously rotates, always in the same direction (clockwise direction), as explained above. It drives a gear 69 which is keyed to one end of a shaft 70 parallel to the shaft 53.

A plurality of control cams 71 are keyed on such shaft 70, the cams 71 controlling the various electromagnets of the device through microswitches 72 connected thereto. There results the performance of such device in the various operating modes, as previously mentioned under paragraphs A, B, C, D of the plant of which it is a part.

In the standard operating condition of said plant, referred to under paragraph A (see FIG. 1), that is when the packeting machine I and the manufacturing machines C and C1 are running, the cigarettes at the outlet of such manufacturing machines C and C1 are directly conveyed or transferred in succession to the inside of the hopper T by means of respective conveying means *t, r, r'* and *t*1, *r*1, *r*1'.

In such condition, the compensating store devices M and M1 remain idle and the respective motors 24 are in a stop or dwelling condition.

In the case of stops, owing to well known causes, of one or both manufacturing machines C, C1 (conditions B or C see FIG. 2 or FIG. 3, respectively), the continuity of the cigarette supply to the conveyors *r, r'* and/or *r*1, *r*1', respectively, is ensured by the compensating store devices M and M1.

In such conditions, with reference for instance to the device M, the direction of rotation of the motor 24 is such as to cause the cylindrical body 2 to rotate in one direction, so that for each movement or step forward a compartment 3 full of cigarettes dwells opposite station R, i.e. at the inlet of the run or section *r'''* arranged to withdraw or remove the cigarettes. During such dwelling, an electromagnet 73, the keeper of which is connected to the end of one arm of a two-armed lever 74 pivoted on a vertical axis supported by means rigid with the casing 1, is energized.

The second arm of said lever 74 acts on the free end of the resilient rod 10 arranged to co-operate with the compartment 3 dwelling opposite the station R, so as to bend said rod in a direction opposite to the direction forward movement of the cylindrical body 2 and to free or open the outlet of such compartment 3.

The respective pile or batch P of cigarettes S, once it has been thus freed from its support, is carried by one of the bars 23 fixed to the chains 18, 18', and is thus caused to slide from its compartment 3 to follow the descending movement of the conveyor 17 through a vertical channel or duct 75 delimited by two fixed parallel side walls.

Once the bar 23 has reached the end of the descending vertical length, it is disengaged from said duct or channel 75 and passes through a slot formed in the channel's left-hand side wall, whereas the pile or batch P of cigarettes S continues its descent by free-falling.

At the end of said fixed channel 75, a second channel 76 delimited by two side walls parallel to and rigid with one another, is provided, and is arranged to take two different positions, i.e. an inclined position so as to temporarily close or block the outlet of the fixed channel or duct 75 located above by means of one of said side walls, and then a vertical position so as to connect said fixed duct or channel 75 to an inclined continuous conveyor 77 endlessly wound around wheels 78 and formed with grooves extending transversely to its conveying direction and having guide 79 arranged to prevent cigarettes from falling out, at its upper run.

The double positioning of said length or section of channel 76 can be effected in the following way.

Its lower end is pivoted on an axis rigid with the casing 1 of the device and parallel to its side walls, one of which (the left-hand one for a person viewing FIGS. 6 and 8) is connected to the keeper of an electromagnet 80 mounted on a plate rigid with the casing 1, whereas the second side wall is connected through a spring 81 to a vertical pin fixed to the same plate.

The microswitches 72 and their circuits are disposed so that, upon arrival of the first cigarette S of the pile or batch P, the electromagnet 80 is in a de-energized condition and said length of channel or duct 76 is in the inclined position shown in FIG. 8, under the action of the spring 81.

In this way, the falling of the cigarettes is controlled so as to maintain their correct positioning and the continuity of the batch or pile P, the electromagnet 80 (see FIG. 6) is then immediately energized and thus said length of duct or channel 76 is vertically aligned, against the resistance of the spring 81, with the upper fixed channel 75, thereby connecting it to the conveyor 77. It should be noted that said fixed channel 75, the channel 76 and the conveyor 77 form together the connection indicated by *r'''* in FIGS. 1, 2, 3, 4 in connection with the machine C and by *r*1''' in connection with machine C1.

When the packeting machine I has stopped and one or both manufacturing machines C and C1 are running (condition D, see FIG. 4), as soon as the cigarettes inside the hopper T have reached the maximum predetermined level, cigarette-switching means of the kind disclosed in the Patent Applications 651,346 of the same Applicant, are controlled by the photocell device F, the switch means being located in the zone where the run or section *r* joins the runs *r'* and *r''* and the area where the run *r*1 joins the runs *r*1' and *r*1'', so as to convey the cigarettes from the manufacturing machines C and C1 to the respective compensating store device M and M1.

FIGS. 5 and 6 show the end section of run *r''* (*r*1'') comprising a horizontal conveyor 82 followed by a vertical connection.

Said horizontal conveyor 82 has two belts 83 arranged in the same plane, endlessly wound on pulleys 84 and 85, and driven in a continuous motion by means not visible in said Figure.

The cigarettes arranged transversely to the conveying direction, as mentioned above, are supported by either of said belts and move forward side by side while being maintained in the correct position by two listels or guide strips 86 extending parallel to the belt conveyors above the row of cigarettes and tangential with the ends of the latter.

Such listels 86 are supported through transverse rods 87 by a plate 88 arranged normal to the axis of the cigarettes and carried in turn by a pin 89 fulcrumed on means rigid with the casing 1.

The vertical connection system following channel 82 comprises an upper channel or duct 90 fulcrumed on the pulley 85 and arranged to take two different positions, and a lower fixed vertical channel 91 the outlet of which is located at said station R of the compensation store device M (M1). Both said channels 90 and 91 are delimited by two parallel side walls arranged at a mutual distance slightly larger than the diameter of a cigarette.

Between the left-hand side wall of the upper channel 90 and the left-hand side wall of the lower channel 91 (see FIGS. 5 and 6), a slit or discontinuity 92 arranged to permit the passage of the bars 23 is formed at the level of the upper horizontal run of the conveyor 17.

The upper channel 90 can, as mentioned above, take two different positions, that is an inclined position such that its outlet is blocked or closed by the right-hand side wall of the lower fixed channel 91 (see FIG. 7) and a vertical position in alignment with the lower channel 91, both positions being reached by energizing and de-energizing respectively an electromagnet 93 mounted on a plate rigid with the casing 1 and connected to the right-hand side wall of the channel 90 through its keeper.

Such electromagnet 93 operates in combination with a spring 94 fixed to one end of the left-hand side wall of the channel 90 and to a vertical pin 95 rigid with the casing 1 at the other end thereof.

On transistion of any new compartment 3 to station R, the upper channel 90 is at first in its inclined position (electromagnet 93 in an energized condition), so that the continuous row of cigarettes descending due to gravity from the horizontal conveyor 82 is stopped by the upper end of the right-hand side wall of the lower channel 91. As soon as the bar 23 enters the zone between the side walls of the lower channel 91, the action of the electromagnet 93 is terminated and the upper channel 90 is biased in a vertical position and, before taking its inclined position again, it delivers the number of cigarettes exactly required for forming one pile P filling the compartment 3 arranged below.

The row of cigarettes carried and assisted by the bar 23 then descends through the lower channel 91 and thus into the compartment 3 of the cylindrical body 2 which is dwelling opposite the station R.

After the bar 23 has left the lower end of said compartment 3, the rod 10, as mentioned above, ensures the support of the pile or batch P of cigarettes S.

In such conditions, the cylindrical body 2 is ready to make a further step in the original direction, thereby transferring a new empty compartment 3 to the station R.

Figure 11:
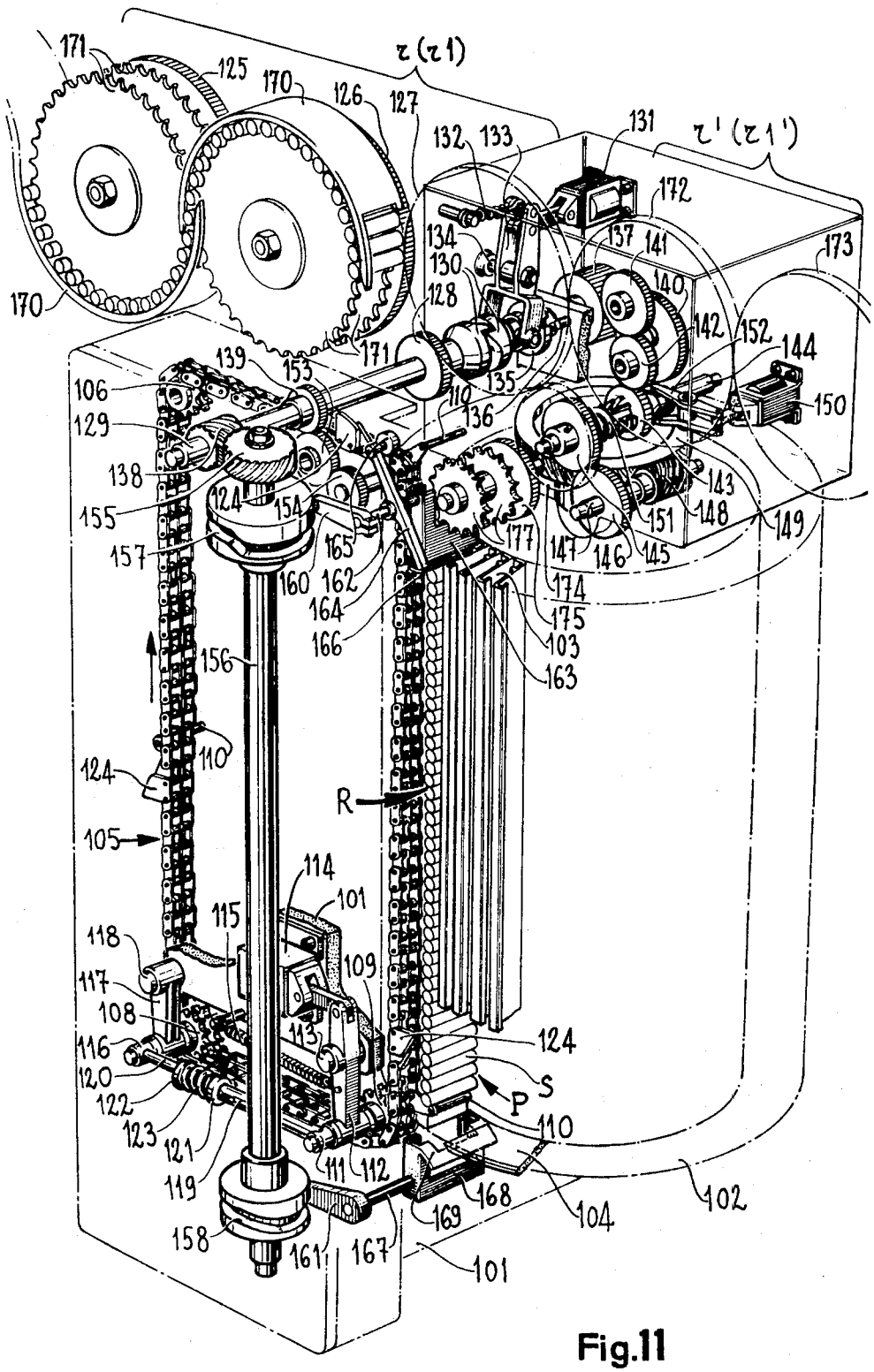
FIG. 11 is a perspective view, with some parts cut away to better illustrate others, of a second embodiment of the compensation store device equipped with its driving means.

The second embodiment of the compensation store device shown in FIGS. 11 to 17 differs from that described above with reference to FIGS. 5 to 10 in that the cylindrical body having storing compartments for cigarettes rotates continuously instead of intermittently. With particular reference to FIG. 11, a general outline and a portion of the casing of such compensating store device provided with a continuous movement are indicated by the numeral 101. The casing is rigid with the base of the respective cigarette manufacturing machine not shown. A vertical axis cylindrical body is generally indicated by 102 and is provided all around it with radial compartments 103 equally spaced from each other and having a depth and width about equal to the length and width, respectively, of a cigarette, and extending vertically from the top or upper base to the bottom or lower base although they are shown only in part. They are designed to receive and discharge piles P of cigarettes S from the manufacturing machine, each pile being one cigarette thick.

This cylindrical body can continuously rotate, in either direction, about its own axis so as to bring its compartments 103 successively to a position R, where the storing of the cigarette piles P or, alternatively, their delivery or feeding to the packeting machine I, occur.

Below the cylindrical body 102, a fixed plate 104 is located in contact with the lower base of the cylindrical body and is arranged to support the cigarette piles P. The plate 104 is formed with an interruption or gap at the location of said position R.

A conveyor 105, comprising two chains arranged side by side is endlessly wound about four horizontally aligned pairs of sprocket wheels 106, 107, 108, 109, the conveyor continuously moving in the clockwise direction with respect to a viewer looking at the Figures.

Said sprocket wheels 106, 107, 108 and 109, one of which, as will be explained below, is motor-driven, are horizontally aligned two by two and arranged in such a way that the conveyor 105 develops along the perimeter of a parallelogram the right-hand side of which corresponds to the conveyor length disposed for direct movement from above downwards, and runs close to said storing and feeding position R. The chains of the conveyor 105 carry three horizontal rods or bars 110 transversely arranged and extending to a given extent towards the center of the cylindrical body 102 so as to run along the right-hand side of said parallelogram deeply inserted into a compartment 103 at the storing or feeding position R.

Each bar 110 follows its trajectory without interfering with the side walls of the compartment 103 which, as mentioned above, continuously rotates. For this purpose the right-hand side of the conveyor 105 takes an inclination which is a function of the speed of rotation of the cylindrical body 102 and of the movement speed of the conveyor 105.

A tubular sleeve 111, rigid with the end of one arm of a two-armed lever 112 fulcrumed on a pin 113 parallel to said axis, is mounted on the axis of the wheel 109, the second arm of said lever being connected to the keeper of an electromagnet 114 rigid with the casing 101.

The action of the electromagnet 114 on said lever 112 is resisted by a spring 115. Owing to such connection, depending upon whether said electromagnet 114 is in an energizing or de-energizing condition, the wheel 109 takes two different positions symmetrical with respect to a vertical line passing through the axis of the wheel 107. Thus the section of the conveyor 105 close to the position R can take two different inclinations, depending upon whether the cylindrical body 102 rotates in counter-clockwise direction (that is, as will be explained below, in the storing direction) or in clockwise direction (that is, as will be explained below, in the feeding direction), see FIGS. 11 to 17.

The shaft of the wheel 108 on which another tubular sleeve is mounted, is pivoted by a rod 117 on a pin 118 parallel to the pin 113 and rigid with the casing 101.

A horizontal hollow shaft 119 is fixed normal to the tubular sleeve 111. A shaft 120 rigid with the tubular sleeve 116 is coaxially inserted, free to slide to a given extent, into the hollow shaft 119.

Between two discs 121 and 122, which are respectively keyed to the hollow shaft 119 and to the shaft 120, there is located a spring 123 for resilient connection between the wheels 108 and 109 and to allow the maintenance of the ascending and descending runs or sections of the conveyor 105 parallel to each other in both operating conditions of the device and to avoid variations in the chain tension upon varying the inclination of the run disposed for a direct movement from above downwards.

At the same distance from each of said three rods 110, on one of the conveyor chains 105, there are mounted three plates 124 lying in the same plane as that of the conveyor and extending outwards from the perimeter thereof. The profile of such a plate 124, the function of which will be explained below has, when proceeding in a direction opposite to the direction of conveyor movement, an ascending inclined length or section followed by a descending length perpendicular to the line of the conveyor 105.

Rotational movement of portions of the device are transmitted from a source not shown in the drawings through a succession of gearwheels 125, 126, 127 mounted on gearwheel axes parallel to each other and normal to the axis of the cylindrical body 102.

A gear 128 idly mounted on a shaft 129 parallel to the gearwheel axes is rotated by the gearwheel 127.

A frontal tooth clutch device of a known type is mounted on shaft 129 and is generally indicated by the numeral 130, one part of said clutch device being rigid with said idle gear 128 and the other part being axially slidable on said shaft 129.

The clutching and declutching operation of said device 130 is controlled by an electromagnet 131 which operates in combination with a spring 132 and is connected to one arm of a two-armed lever 133 pivoted on a horizontal pin 134 normal to the shaft 129 and fixed to the casing 101.

In the energized condition of said electromagnet 131, the second arm of the lever 133 acts on the axially sliding part of the device 130 and causes it to become engaged with the part idly rotating with the gear 128, thereby obtaining rotation of the shaft 129.

In the de-energized condition of the electromagnet 131, the spring 132 by moving the lever 133 in a direction opposite to the previous one, disengages the device 130 and thus stops the shaft 129.

A device 135 is mounted on the same shaft 129 and is rigid with the axially slidable part of the device 130. The device 135 has a peripheral groove which, in combination with a fixed pin 136, acts as blocking element for the shaft 129 during the disengagement or declutching operation.

To the shaft 129 are also keyed (see FIG. 11) a gear 137 at the rear end thereof, and from its front end, a helical gear 138 and a spur gear 139.

Gear 137 rotates a gear 140, and a gear 141 meshing with a gear 142.

A gear 143 axially slidable on a shaft 144 parallel to the shaft 129 is rotated by the gear 140 or, alternatively, by the gear 142.

To the shaft 144 is in turn keyed a gear 145 which through a gear 146 rotates the shaft 147 parallel to the shaft 144 and to which there is keyed a helical gear 148 arranged to mesh with the toothed wheel 149 keyed to the axis of the cylindrical body 102. The latter is thus continuously rotated in clockwise direction or in counter-clockwise direction, depending upon whether it is operating in a feeding or delivering stage or in the storing stage.

These directions of rotation are respectively determined by coupling the gear 143 to the gear 140 or, alternatively, the gear 142.

Such operation is carried out by means of an electromagnet 150 rigid with the casing 101 and operating in combination with a spring 151 mounted on the shaft 144 between the two gears 143 and 145.

The electromagnet 150, the keeper of which is connected through a two armed lever 152 pivoted on a vertical axis to a sleeve rigid with the gear 143, when energized causes said gear 143 to mesh with the gear 142, thereby rotating the cylindrical body 102 in a counter-clockwise direction.

When such electromagnet 150 is in a de-energized condition, the pressing action of the spring 151 causes the gear 143 to mesh with the gear 140, thereby rotating the cylindrical body 102 in clockwise direction.

A gear 154, keyed to the axis of said wheel 107 which drives the chain conveyor 105, is rotated by the already-mentioned gear 139 through an idle gear 153.

The already-mentioned helical gear 138 rotates another gear 155 rigid with the upper end of a vertical shaft 156 to which two drum cams 157 and 158 are keyed in the order from above downwards. Horizontal idling rollers 159, each carried by one end of an upper lever 160 or a lower lever 161, ate arranged to follow the grooves formed in the lateral surfaces of such cams 157 and 158.

The upper lever 160 is pivoted on one end of a pin 162 parallel to the shaft 129 and supported in a manner not visible in the Figure by the casing 101.

A channel 163 which is rectangular in cross-section and acts as a connecting element between the feeding run or section *r''* (*r*1'') and the inlet of the compartments 103 of the cylindrical body 102, is rigidly fixed to the second end of said pin 162 at the position R.

On said pin 162 is also idly pivoted a two-armed lever 164 which has at the free end of one arm an idle roller 165 whose axis is parallel to the pin 162, the roller 165 being arranged to be periodically contacted and raised by the profiles of the already-mentioned cam plates 124.

A plate 166 is rigid with the end of the second arm of said lever 164 and is arranged to block the outlet of the channel 163 during the movement of the idle roller 165 along the ascending length or section of the cam plate 124.

The lower lever 161 is pivoted to one end of a pin 167 parallel to the pin 162 and supported in a way not shown in the Figure by the casing 101.

A channel 168 having a rectangular cross-section and acting as a connecting element between the outlet of the compartments 103 and the inlet of the removing run *r'''* (*r*1''') is rigid with the second end of said pin 167 in the position R.

Both channels 163 and 168 have cuts arranged to allow the rods 110 to pass through without interfering with their side wall. The right-hand side walls of the lower channel 168 also has an edge 169 located flush with the plate 104 at the location of its gap or interruption zone.

After the description of the various members forming the device according to the invention and of the respective mechanical actuation or drive means, let us now consider the behaviour of such a device in connection with the various operating modes of the plant of which it is a part, such modes being those previously mentioned under paragraphs A, B, C, D.

In normal operating conditions, mentioned under paragraph A (see FIG. 1), that is when a packeting machine I and the manufacturing machines C and C1 are running, the cigarettes are successively conveyed directly from the outlet of such manufacturing machines C and C1 to the inside of the hopper T through the succession of conveying means *t, r, r'* and *t1, r1, r1'*, respectively.

In such conditions, the electromagnet 131 for each compensating store device is not energized and thus the device M associated with the machine C and the device M1 associated with the machine C1 remain dwelling and stationary.

In the remaining operating conditions of said plant, as mentioned under paragraphs B, C, D (see FIGS. 2, 3, 4), the electromagnets 131 for the compensating store devices are energized and are arranged to intervene during the storing stage or, alternatively, in the feeding or delivery stage, as will be explained below.

In the case of a dwell, for any reason whatsoever, of the packeting machine I and of normal operation of one or both the manufacturing machines C and C1 (see FIG. 4), as soon as the cigarettes have reached the predetermined maximum level inside the hopper T, one or both the switching or deviating means located at the position where the run r and the runs *r'* and *r''* as well as the run *r1* and the runs *r1'* and *r1''* meet, are actuated by means of a photocell device F, so as to convey the cigarettes from the manufacturing machines C and C1 to the respective compensating store device M or M1.

FIGS. 1–4 and 11 et seq show the end section of the run *r* (*r1*), the initial section of the run *r'* (*r1'*), and the cigarette feeding run *r''* (*r1''*) to the compensating store device M (M1).

The cigarettes are transferred along said runs by means of a succession of rollers or pairs of coaxial discs mounted on axes all parallel to the shaft 129 and continuously rotating.

The cigarettes transverse to the direction of movement, are located in seats formed all around said rollers or said pairs of discs and are held in a correct position by guides 170.

The drive means for said runs are the same as those described with reference to the cylindrical body 102, the motion being transmitted by means of a succession of gearwheels each of which is coaxial to and rigid with one of said rollers or pairs of discs.

As far as the end section of the run *r* (*r1*) is concerned, said gearwheels are those already mentioned and indicated by 125, 126 and 127 and associated with the pairs of the pairs of discs 171.

The gearwheel 127 rotates in turn the series of gearwheels for the run or section *r'* (*r1'*), two of which, those indicated by 172 and 173, are shown in FIG. 11, and the gearwheels 174 and 175 respectively associated with the pairs of discs 176 and 177 for the run *r''*(*r1''*) which opens into the channel 163.

At the location of the discs 171 for the gearwheel 127, there are provided the switching or deviating means formed as disclosed in the already-mentioned Patent Application No. 3325A/, 75 which are arranged according to that application to direct the cigarettes from discs 171 of gear 127 of run *r*(*r1*) to either wheel 172 of run *r'*(*r1'*) or to discs 176 of run *r''* (*r1''*) going to the compensating store device M (M1).

Thereupon, (see FIGS. 12, 13, 14), the electromagnet 150 is energized thereby causing the gear 143 and the gear 142 to mesh together by means of the lever 152.

As mentioned above, this results in the rotation in counter-clockwise direction of the cylindrical body 102 which successively transfers its empty compartments 103 to the position R.

The electromagnet 114 is energized in such a way that, for the above-mentioned reasons, the section of conveyor 105 close to the position R takes an inclination from the left rightwards with respect to a vertical line in the direction of its forward movement.

When an empty compartment 103 reaches the position R, one of the rods 110 is getting ready to enter in it and at the same time the idle roller 165 runs down along the descending length of the profile of the cam plate 124, thereby freeing the strip 166 from the bottom of the channel 163.

The cigarettes are then free to fall due to gravity from the end pair of discs 177 of the run *r''* (*r1''*), throughout said channel 163, into the compartment 103 to form a uniform row which has the rod 110 as a mobile support.

During such operation, the channel 163 continuously varies its inclination by being rotated by the cam 157 about the pin 162 so as to ensure the connection between the disks 177 of the run *r''* (*r1''*) and the mobile compartment 103 at the angular velocity of the cylindrical body 102 while the pile P is being formed.

Once the compartment 103 has been filled, i.e. upon disengagement of the rod 110 from the bottom of this compartment, the idle roller 165 is engaged by the ascending length or section of the profile of a new plate 124, so that the strip 166 is inserted into the space between said channel 163 and the inlet of the compartment 103, thereby interrupting the cigarette flow.

The channel 163 is controlled by the cam 157 to make a rapid backward oscillation movement above the successive empty compartment 103 which has arrived at the position R, whereas the strip 166 at the end of the stroke of the roller 165 along the ascending length of the plate 124 moves away from the outlet of the channel 163. In the case of stopping of one or both manufacturing machines C and C1 (see FIG. 2 or FIG. 3), the feeding continuity of the cigarettes to the respective conveyors *r, r'* and/or *r1, r1'* is ensured by the compensating store devices M and M1.

In such conditions, for instance with reference to the device M, the electromagnet 150 is de-energized and under the pressing action of the spring 151 the gear 143 and the gear 140 are caused to mesh with one another.

This results, as already mentioned above, in the rotation in the clockwise direction of the cylindrical body 102 and thus in the transfer of the compartments 103 full of cigarettes to the position R (see FIGS. 15, 16, 17).

A de-energizing control is also applied to the electromagnet 114 so that, always in view of what has been described above, the section of conveyor 105 close to the position R takes, in the direction of its movement, an inclination from the right leftwards with respect to a vertical line.

Each pile P of cigarettes S no longer supported at the position R by the plate 104, enters the inlet of the channel 168 which is then vertically arranged below the cylindrical body 102.

During such operation, similarly to what has been described above, the channel 168, upon control from the cam 158, varies its inclination by rotating about the pin 167 so as to ensure throughout the duration of the descent of the pile P the connection between the mobile compartment 103 at the angular speed of the cylindrical body 102 and the run *r'''* (*r1'''*) comprising for instance a continuous conveyor 178 endlessly wound about wheels 179 and having grooves transversely extending to its direction of movement.

The already-mentioned edge 169 on the right-hand side walls of the channel 168 is arranged to support the successive pile P of cigarettes already arrived at the location of the gap or interruption zone of the plate 104 and waiting for the channel 168 to return, upon control of the cam 158, with a rapid backward oscillation, into the vertical connection position between a new compartment 103 full of cigarettes and the run *r'''* (*r1'''*).

Obviously, the above-described embodiment of the compensating store device has been given only by way of example and it should be understood that the cylindrical body comprising radial compartments can be provided with a unidirectional movement for storing and respectively feeding stages by means of simple and obvious expedients, so as to avoid a long dwelling of piles of cigarettes within the store.

I claim:

1. A plant having at least two cigarette manufacturing machines, one packaging machine, and a storage unit for compensating operating unbalances of the manufacturing and packaging machines, the storage unit comprising;

a compensating storage cylinder having means for rotating it about a vertical axis and having vertically and radially extending cigarette-storing compartments distributed about the cylinder's circumference, each compartment having a top and a bottom and being dimensioned to permit cigarettes to be horizontally disposed in a cigarette pile one cigarette thick in the compartment between the top and the bottom;

cigarette support means capable of actuation for enabling cigarettes in such a pile to be slidingly moved downwardly along the compartment;

a conveyor system, including (a) a cigarette-feeding conveyor for feeding a stream of individual cigarettes from a cigarette-manufacturing machine to a fixed location at the top of the cylinder for discharge into the top of one of the compartments during a first type of operating unbalance between the manufacturing machine and a cigarette-packaging machine, and (b) a cigarette-withdrawing conveyor for withdrawing a stream of individual cigarettes from the bottom of one of the compartments to a fixed location at the bottom of the cylinder and further to the packaging machine during a second type of operating unbalance between the machines;

means for selective actuation, in response to either type of unbalance, of the respective conveyor and of the cigarette support means; and transfer channel means for, selectively, delivering cigarettes from the feeding conveyor into the top of one of the compartments, and discharging cigarettes from the bottom of one of the compartments to the withdrawing conveyor, comprising two transfer channels, each tiltably mounted at one of said fixed locations and each having means for tilting it to provide a path for cigarettes smoothly sliding between the pile and the respective one of the conveyors, and to close said path.

2. A plant according to claim 1 in which the cigarette support means comprises a set of rigid rods and a conveyor chain unit mounted for movement thereof upon said actuation and supporting the rods horizontally and so as to enable them in said movement successively to enter each compartment adjacent said fixed location at the top, to be downwardly guided in the compartment, and to leave the compartment adjacent said fixed location at the bottom, to control the feeding of cigarettes during the first type of operating unbalance and the withdrawing of cigarettes during the second type of operating unbalance.

3. A plant according to claim 2 in which the cigarette support means also includes flexible rods, mounted at the bottom of the cylinder, one at the bottom of each compartment; the means for actuation of the cigarette support means including means for controlled flexing of the flexible rod disposed at the fixed location at the bottom, in synchronism with the actuation of the conveyor system, to successively open and close the bottom of the respective compartment.

4. A plant according to claim 3 in which the flexible rods are resilient, the means for controlled flexing comprising electromagnetic means for flexing the rod at the fixed bottom location in one direction, subject to resilient return flexing of the rod.

5. A plant for producing cigarette packets, utilizing a system for directly feeding a stream of individual cigarettes disposed transversely of the stream from at least one manufacturing machine to a packeting machine, comprising;

a compensating storage unit constituted by a cylindrical body provided with radially extending cigarette-storing compartments distributed about the body's circumference, said compensating storage unit having a storing construction for storing cigarettes in a succession of individual cigarettes transversally disposed, according to quantities of cigarettes constituting portions of a flowing cigarette stream;

means controlled by cigarette manufacturing and packeting machines for rotating said cylindrical body about a vertical axis to cause a horizontal transition of said compartments, each radially extending cigarette-storing compartment being parallel to said vertical axis and having an open top and an open bottom and each compartment being dimensioned to permit cigarettes to be horizontally disposed in a cigarette pile one cigarette thick in the compartment between the top and the bottom;

an upper infeeding channel and a lower withdrawing channel respectively positioned above and below said cylindrical body in areas thereof providing said open tops and open bottoms of said compartments, said upper and lower channels being generally vertically aligned one relative to the other;

a movable device having uniformly spaced apart rigid cantilever rods and means for taking successive ones of said cantilever rods, disposed perpendicularly to said vertical axis of the cylindrical body, into one of the radially disposed cigarette-storing compartments which is generally vertically aligned with and between said upper infeeding and lower withdrawing channels; and intercepting means for stopping the flowing of the stream of individual cigarettes along said upper infeeding and lower withdrawing channels and relative to the open top and open bottom of said one cigarette-storing compartment in synchronism with the transition of the cigarette-storing compartments between said upper infeeding and lower withdrawing channels.

6. A plant according to claim 5, in which said movable device is driven by said means for rotating said cylindrical body.

7. A plant according to claim 5, in which said intercepting means are controlled by said means for rotating said cylindrical body.

* * * * *